US008430479B2

(12) United States Patent
Nishida

(10) Patent No.: US 8,430,479 B2
(45) Date of Patent: Apr. 30, 2013

(54) LIQUID DROPLET JETTING APPARATUS

(75) Inventor: Katsunori Nishida, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 55 days.

(21) Appl. No.: 13/242,088

(22) Filed: Sep. 23, 2011

(65) Prior Publication Data

US 2012/0081433 A1 Apr. 5, 2012

(30) Foreign Application Priority Data

Sep. 30, 2010 (JP) ..... 2010-220901

(51) Int. Cl.
*B41J 2/165* (2006.01)

(52) U.S. Cl.
USPC ..... 347/29; 347/30

(58) Field of Classification Search ..... 347/29, 347/30
See application file for complete search history.

(56) References Cited

U.S. PATENT DOCUMENTS

| | | | | |
|---|---|---|---|---|
| 2011/0050796 | A1* | 3/2011 | Nishida | 347/29 |
| 2011/0050798 | A1* | 3/2011 | Shindo et al. | 347/30 |
| 2011/0050799 | A1* | 3/2011 | Nishida | 347/30 |
| 2011/0285785 | A1* | 11/2011 | Hayashi | 347/31 |
| 2011/0310170 | A1* | 12/2011 | Kato | 347/30 |

FOREIGN PATENT DOCUMENTS

| | | |
|---|---|---|
| JP | 10-258531 | 9/1998 |
| JP | 2008-260172 | 10/2008 |

* cited by examiner

*Primary Examiner* — Julian Huffman
(74) *Attorney, Agent, or Firm* — Frommer Lawrence & Haug LLP

(57) ABSTRACT

A liquid droplet jetting apparatus includes a liquid droplet jetting head which has a liquid droplet jetting surface provided with a plurality of nozzles opening thereon in order to jet liquid droplets of a liquid; a cap member which has a size to cover the openings of the nozzles of the liquid droplet jetting head and which is formed with a suction port; a moving mechanism which moves the cap member to make contact/separation with respect to the liquid droplet jetting surface; a purge mechanism which is connected to the suction port of the cap member and which performs purge to discharge the liquid from the nozzles in a state in which the cap member is brought in contact with the liquid droplet jetting surface; and a controller which controls the liquid droplet jetting head, the moving mechanism, and the purge mechanism.

14 Claims, 10 Drawing Sheets

LIQUID DROPLET JETTING APPARATUS

CROSS REFERENCE TO RELATED APPLICATION

The present application claims priority from Japanese Patent Application No. 2010-220901, filed on Sep. 30, 2010, the disclosure of which is incorporated herein by reference in its entirety.

BACKGROUND OF THE INVENTION

1. Field of the Invention:

The present invention relates to a liquid droplet jetting apparatus which jets liquid droplets.

2. Description of the Related Art:

A liquid droplet jetting apparatus, which is provided with a liquid droplet jetting head for jetting liquid droplets from nozzles, has been hitherto known. The liquid droplet jetting apparatus is occasionally provided with the means for recovering the performance by discharging the foreign matter, the bubble, and/or the viscosity-increased liquid from the nozzles when the liquid droplet jetting performance of the head is deteriorated, for example, due to foreign matter and/or bubble mixed in liquid flow passages, which are provided in the liquid droplet jetting head, and/or liquid which is dried to increase the viscosity in the nozzle.

As for the liquid droplet jetting apparatus described above, Japanese Patent Application Laid-open Nos. 2008-260172 and H10-258531 disclose such an ink-jet recording apparatus that an image or the like is recorded by jetting an ink from nozzles with respect to a recording medium. The ink-jet recording apparatus includes an ink-jet head, a cap member which is brought in tight contact with an ink-jetting surface of an ink-jet head to cover the plurality of nozzles, and a suction pump which is connected to a suction port formed for the cap member. The ink is sucked out from the nozzles by reducing the pressure in the cap member by means of the suction pump in a state in which the plurality of nozzles are covered with the cap member, and thus the foreign matter, the bubble and the like, which are contained in the ink-jet head, are discharged together with the ink (the recovery operation as described above is hereinafter referred to as "suction purge").

In the case of the ink-jet recording apparatus as described in Japanese Patent Application Laid-open Nos. 2008-260172 and H10-258531, the ink, which is adhered to the ink-jetting surface of the ink-jet head, is wiped out by a wiper after the suction purge (wiping operation). Further, in order to adjust the meniscus of the nozzles after the wiping, flashing (also referred to as "preparatory discharge") is performed, in which the liquid droplets are jetted from the nozzles prior to the actual recording operation. The ink (discharged ink or waste ink), which is once discharged by the suction purge, is sucked into the nozzles on account of the back pressure in the ink-jet head in some cases, and/or the ink (discharged ink or waste ink) is adhered to the nozzle openings and the ink is sucked by the wiping in other cases. Therefore, the flashing is performed while simultaneously satisfying a purpose to discharge the ink which would be otherwise sucked into the nozzles as described above.

Japanese Patent Application Laid-open Nos. 2008-260172 and H10-258531 disclose the following technique. That is, ink discharge amount during the flashing (hereinafter referred to as "flashing amount") is allowed to differ depending on the type of the ink to be jetted, without allowing the flashing amount to be identical in relation to all of the nozzles, so that the color mixture is effectively avoided. Specifically, in Japanese Patent Application Laid-open No. 2008-260172, the flashing amount is increased for the nozzles which jet the ink having a large specific gravity as compared with the nozzles which jet the ink having a small specific gravity. Further, in Japanese Patent Application Laid-open No. H10-258531, the higher the brightness (luminosity) of the ink is, the greater the flashing amount is.

SUMMARY OF THE INVENTION

By the way, when the cap member is separated from the ink-jetting surface after the suction purge, such a state arises that the ink is connected or continued between the cap member and the ink-jetting surface (ink bridge). When the ink bridge is cut (disconnected or discontinued), the ink is scattered to the surroundings. In relation to this situation, the present inventors have investigated the fact that the ink is suppressed from being scattered by separating the cap member while inclining the cap member with respect to the ink-jetting surface (see FIG. 4B referred to in an embodiment) so that the ink bridge is locally formed at a portion at which the cap member is separated from the ink-jetting surface last.

In this case, the nozzles, which are disposed nearer to the position of the ink-jetting surface at which the cap member is separated last, are disposed nearer to the ink bridge. Therefore, the waste ink, which forms the ink bridge, may highly possibly enter the nozzles. In such a situation, the waste ink as described above is the ink which has been discharged together with the foreign matter, the bubble, and/or the viscosity-increased ink having been contained in the ink-jet head, and the ink is foamed in many cases. Therefore, if the ink as described above remains in the nozzles, it is feared that any harmful influence may be exerted on the liquid droplet jetting operation to be performed thereafter. Therefore, it is necessary that the ink as described above should be completely discharged from the nozzles. Therefore, when the ink bridge is formed locally, it is desired that the flashing is sufficiently performed especially for the nozzles disposed near to the position at which the bridge is formed so that the waste ink, which has been sucked into the nozzles, is reliably discharged. On the other hand, if a somewhat large flashing amount is evenly set for all of the nozzles, the liquid amount, which is consumed by the flashing, is increased.

In relation to this viewpoint, it is described in Japanese Patent Application Laid-open Nos. 2008-260172 and H10-258531 that the flashing amount is changed depending on the type of the ink to be jetted, but it is not disclosed that the flashing amounts of the respective nozzles are set depending on the distances from the ink bridge.

An object of the present invention is to set the flashing amounts of the nozzles depending on the distances from a position of a liquid droplet jetting surface at which the bridge is formed in the flashing after the suction purge, so that the liquid consumption amount is suppressed during the flashing while reliably discharging the liquid sucked into the nozzles.

According to an aspect of the present invention, there is provided a liquid droplet jetting apparatus for jetting liquid droplets of a liquid including: a liquid droplet jetting head which has a liquid droplet jetting surface on which a plurality of nozzles are open to jet the liquid droplets of the liquid; a cap member which covers openings of the nozzles of the liquid droplet jetting head, which is formed with a suction port, and which has a contact surface to make contact with the liquid droplet jetting surface; a moving mechanism which moves the cap member to make contact with and separate from the liquid droplet jetting surface; a purge mechanism which is connected to the suction port of the cap member and which performs purge to discharge the liquid from the nozzles in a state in which the cap member is brought in contact with the liquid droplet jetting surface; and a controller which is configured to control the liquid droplet jetting head, the moving mechanism, and the purge mechanism, wherein: the cap member is constructed tiltably such that the contact surface is inclined with respect to the liquid droplet jetting surface when the cap member is separated from the liquid droplet jetting surface; after performing the purge by controlling the moving mechanism and the purge mechanism, the controller controls the moving mechanism such that the cap member is separated from the liquid droplet jetting surface in an inclined state in which the contact surface is inclined with respect to the liquid droplet jetting surface and the controller controls the liquid droplet jetting head such that first flashing is performed to discharge the liquid by jetting the liquid droplets from the plurality of nozzles respectively; and in the first flashing, the controller controls the liquid droplet jetting head such that a discharge amount from a first nozzle of the nozzles is greater than a discharge amount from a second nozzle of the nozzles, the second nozzle being disposed farther than the first nozzle from a position, on the liquid droplet jetting surface, at which a part of the contact surface of the cap member is lastly separated from the liquid droplet jetting surface when the cap member in the inclined state is separated from the liquid droplet jetting surface.

When the cap member is separated from the liquid droplet jetting surface in the inclined state after performing the purge by the purge mechanism, a liquid bridge is formed at the position at which the cap member is separated from the liquid droplet jetting surface last. In the aspect of the present invention, the flashing is performed by controlling the liquid droplet jetting head such that the discharge amount from the first nozzle is greater than that of the second nozzle which is disposed farther than the first nozzle from the position of formation of the bridge at which the bridge is formed. Accordingly, the liquid, which has been sucked into the nozzles, can be reliably discharged. Further, the flashing amount is decreased for the nozzles disposed far from the position of formation of the bridge. Thus, the consumption amount of the liquid consumed by the flashing is suppressed.

BRIEF DESCRIPTION OF THE DRAWINGS

FIGS. 4A and 4B show sectional views in relation to the vertical plane including the transport direction to illustrate a cap member and a cap driving mechanism when the suction purge is executed, wherein FIG. 4A shows a state provided when the capping is performed, and FIG. 4B shows a state provided when the cap member is separated.

FIGS. 5A and 5B show sectional views in relation to the vertical plane including the scanning direction to illustrate the cap member when the suction purge is executed, wherein FIG. 5A shows a state provided when the capping is performed, and FIG. 5B shows a state provided when the cap member is separated.

DESCRIPTION OF THE PREFERRED EMBODIMENTS

Next, an embodiment of the present invention will be explained.

Figure 1:
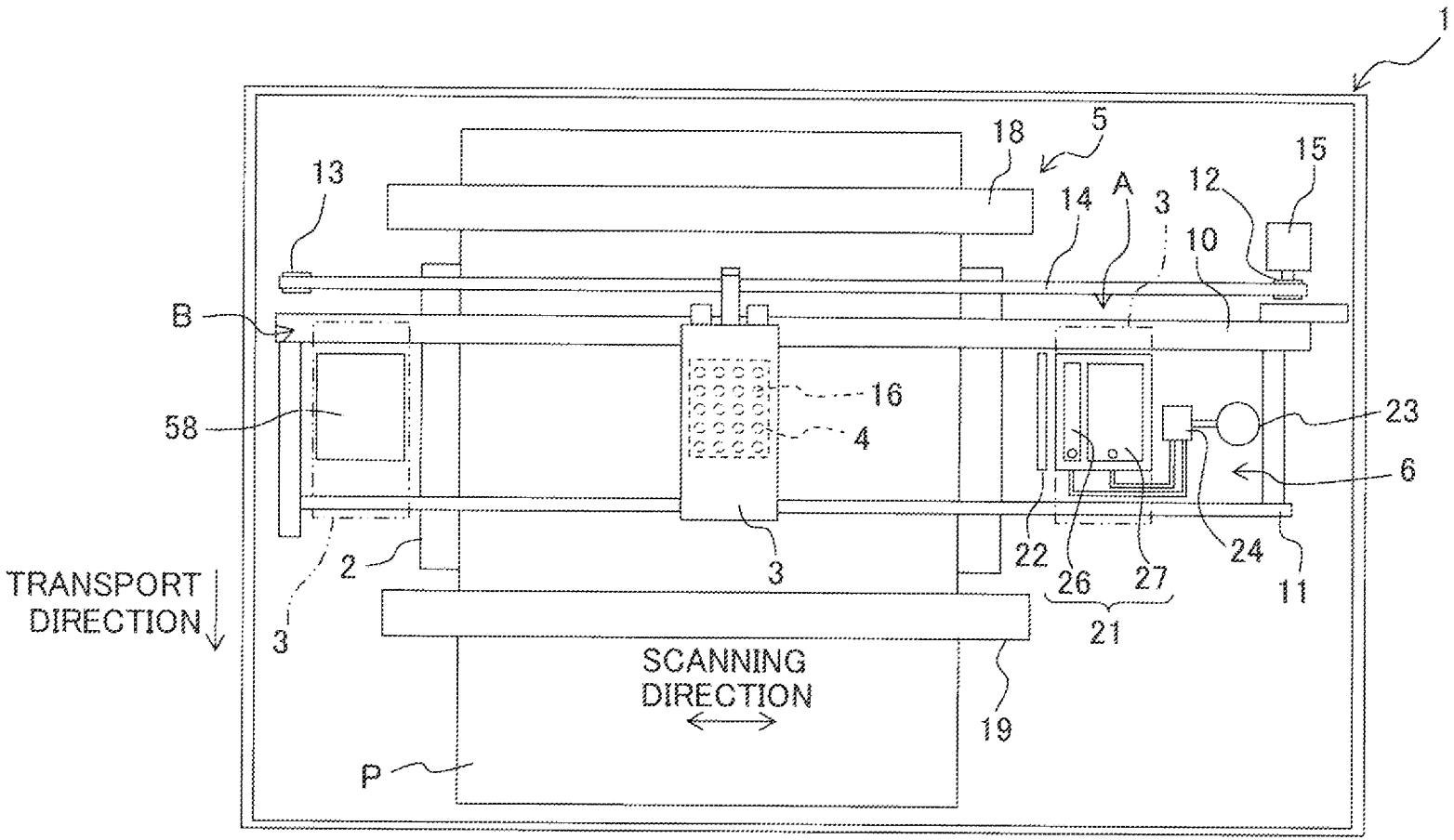
FIG. 1 shows a plan view illustrating a schematic arrangement of an ink-jet printer according to an embodiment of the present invention.

As shown in FIG. 1, an ink-jet printer 1 (liquid droplet jetting apparatus) includes, for example, a platen 2 on which a recording paper P is placed, a carriage 3 which is reciprocatively movable in the scanning direction parallel to the platen 2, an ink-jet head 4 (liquid droplet jetting head) which is carried on the carriage 3, a transport mechanism 5 which transports the recording paper P in the transport direction perpendicular to the scanning direction, a maintenance unit 6 which performs various maintenance operations in relation to the recovery and the maintenance for the liquid droplet jetting performance of the ink-jet head 4, and a control device 7 (controller) (see FIG. 7) which is in charge of the control of the entire ink-jet printer 1.

The recording paper P, which is supplied from an unillustrated paper feed mechanism, is placed on the upper surface of the platen 2. Two guide rails 10, 11, which extend in parallel in the left-right direction (scanning direction) as shown in FIG. 1, are provided over or above the platen 2. The carriage 3 is constructed to be reciprocatively movable in the scanning direction along the two guide rails 10, 11 in an area facing the platen 2. The two guide rails 10, 11 extend to the positions separated in the leftward direction and the rightward direction as shown in FIG. 1 along the scanning direction from the platen 2. The carriage 3 is constructed to be movable to the positions separated in the left and right directions from the platen 2 as the non-recording area from the area (recording area) facing the recording paper P on the platen 2. Further, an endless belt 14, which is wound and applied between two pulleys 12, 13, is connected to the carriage 3. When the endless belt 14 is driven to travel by means of a carriage driving motor 15, the carriage 3 is moved in the scanning direction in accordance with the travel of the endless belt 14.

The ink-jet head 4 is attached to a lower portion of the carriage 3. The lower surface of the ink-jet head 4, which is parallel to the upper surface of the platen 2, is formed with an ink-jetting surface 4*a* (liquid droplet jetting surface, see FIGS. 4A and 4B and FIGS. 5A and 5B) on which a plurality of nozzles 16 are open. Inks are jetted from the plurality of nozzles 16 of the ink-jetting surface 4*a* toward the recording paper P placed on the platen 2.

Figure 2:
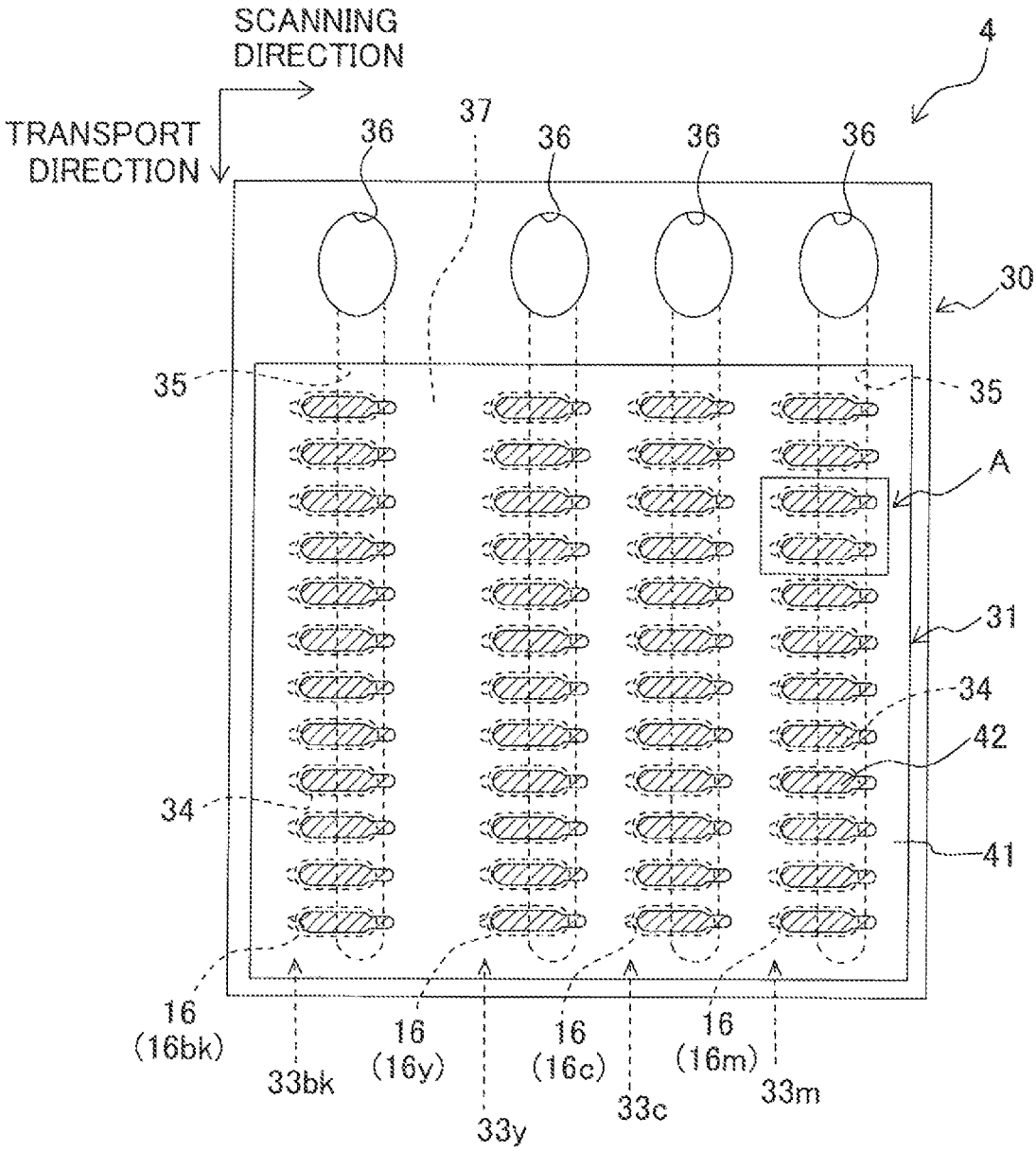
FIG. 2 shows a plan view illustrating an ink-jet head.
Figure 3A:
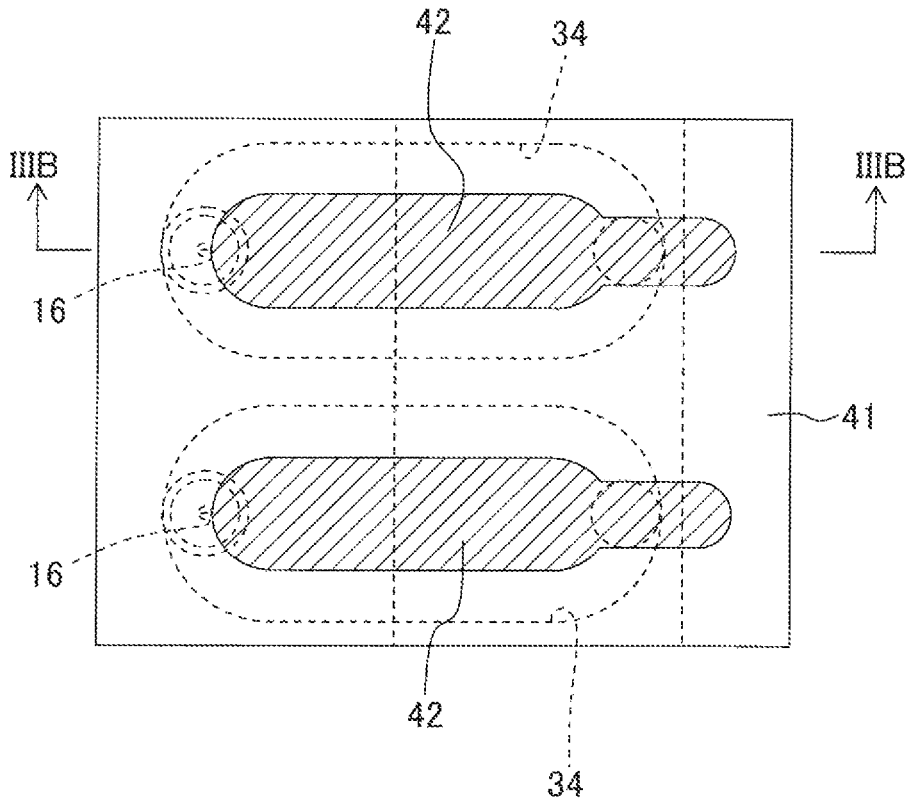
FIG. 3A shows an enlarged view illustrating Portion A shown in FIG. 2.

The arrangement of the ink-jet head 4 will be specifically explained. As shown in FIGS. 2 and 3, the ink-jet head 4 includes a flow passage unit 30 which is formed with the plurality of nozzles 16 and a plurality of pressure chambers 34 communicated with the plurality of nozzles 16 respectively, and a piezoelectric actuator 31 which is arranged on the upper surface of the flow passage unit 30.

Figure 3B:
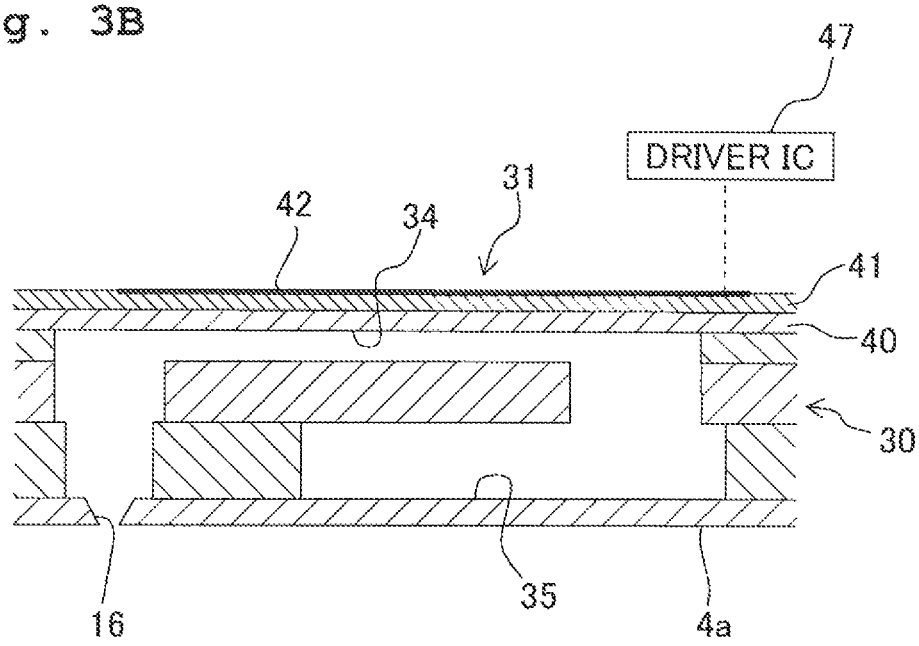
FIG. 3B shows a sectional view taken along a line IIIB-IIIB shown in FIG. 3A.

As shown in FIG. 3B, the flow passage unit 30 has such a structure that four plates are stacked. The plurality of nozzles 16 are formed on the lower surface (ink-jetting surface 4*a*) of the flow passage unit 30. As shown in FIG. 2, the plurality of nozzles 16 are arranged in the transport direction to constitute four nozzle arrays 33 aligned in the scanning direction. The four color inks in total, i.e., the black ink as a pigment ink and the three color inks (yellow, cyan, magenta) as dye inks are jetted respectively from the nozzles 16 (16*bk*, 16*y*, 16*c*, 16*m*) belonging to the four nozzle arrays 33 (33*bk*, 33*y*, 33*c*, 33*m*) respectively. The nozzles 16*bk* which jet the liquid droplets of the black ink are hereinafter referred to as "black nozzles 16*bk*" as well. The three types of nozzles 16*y*, 16*c*, 16*m* which jet the liquid droplets of the three color inks are hereinafter referred to as "color nozzles 16*cl*" as well. An empty area 37 exists between the black nozzle array 33*bk* and the color (yellow) nozzle array 33*y* on the lower surface of the flow passage unit 30. The area 37 is an area to make abutment against a partition wall 21*c* which partitions two cap sections 26, 27 of a cap member 21 as described later on (see FIG. 5).

The plurality of pressure chambers 34, which are communicated with the plurality of nozzles 16 respectively, are formed in the flow passage unit 30. Four arrays of the plurality of pressure chambers 34 are arranged as well corresponding to the four nozzle arrays 33. Further, the flow passage unit 30 is formed with four manifolds 35 which extend in the transport direction respectively and which supply the four color inks of black, yellow, cyan, and magenta to the four arrays of the pressure chambers. The four manifolds 35 are connected to four ink supply ports 36 which are formed on the upper surface of the flow passage unit 30.

As shown in FIG. 3B, the piezoelectric actuator 31 includes a vibration plate 40 which covers the plurality of pressure chambers 34, a piezoelectric layer 41 which is arranged on the upper surface of the vibration plate 40, and a plurality of individual electrodes 42 which are arranged corresponding to the plurality of pressure chambers 34 on the upper surface of the piezoelectric layer 41. The plurality of individual electrodes 42, which are positioned on the upper surface of the piezoelectric layer 41, are connected respectively to a driver IC 47 which drives the piezoelectric actuator 31. A predetermined driving voltage is independently applied from the driver IC 47 to the plurality of individual electrodes 42. The vibration plate 40, which is positioned on the lower surface of the piezoelectric layer 41, is formed of a metal material, and the vibration plate 40 plays a role of the common electrode which is opposed to the plurality of individual electrodes 42 with the piezoelectric layer 41 intervening therebetween. The vibration plate 40 is connected to the ground wiring line of the driver IC 47, and the vibration plate 40 is always held at the ground electric potential.

The piezoelectric actuator 31 is operated as follows. That is, when the predetermined driving voltage is applied from the driver IC 47 between a certain individual electrode 42 and the vibration plate 40 as the common electrode, then the volume change of the pressure chamber 34 is caused in accordance with the piezoelectric deformation (piezoelectric strain) of the piezoelectric layer 41 interposed between the both, and the pressure is applied to the ink contained in the pressure chamber 34. In this situation, the liquid droplets of the ink are jetted from the nozzle 16 communicated with the pressure chamber 34.

With reference to FIG. 1 again, the transport mechanism 5 has two transport rollers 18, 19 which are arranged to interpose the platen 2 in the transport direction. The recording paper P, which is placed on the platen 2, is transported in the transport direction (frontward direction as viewed in FIG. 1) by means of the two transport rollers 18, 19.

In the ink-jet printer 1, the inks are jetted from the ink-jet head 4 which is reciprocatively moved in the scanning direction (left-right direction as shown in FIG. 1) together with the carriage 3 with respect to the recording paper P which is placed on the platen 2. Further, the recording paper P is transported in the transport direction (frontward direction as viewed in FIG. 1) by means of the two transport rollers 18, 19. Accordingly, the ink-jet printer 1 prints, for example, a desired image and/or letters on the recording paper P.

Next, the maintenance unit 6 will be explained. As shown in FIG. 1, the maintenance unit 6 is arranged at the position separated on one side (right side as shown in FIG. 1) in the scanning direction with respect to the platen 2 (maintenance position: Position A at which the carriage 3 is depicted by two-dot chain lines in FIG. 1). The maintenance unit 6 includes, for example, a cap member 21 which makes contact with the ink-jetting surface 4*a* of the ink-jet head 4 to cover the openings of the plurality of nozzles 16 therewith, a suction pump 23 (purge mechanism) which is connected to the cap member 21, and a wiper 22 which wipes out the inks adhered to the ink-jetting surface 4*a* after the suction purge. In FIGS. 4A and 4B and FIGS. 5A and 5B, the wiper 22 is omitted from the illustration.

Figure 4A:
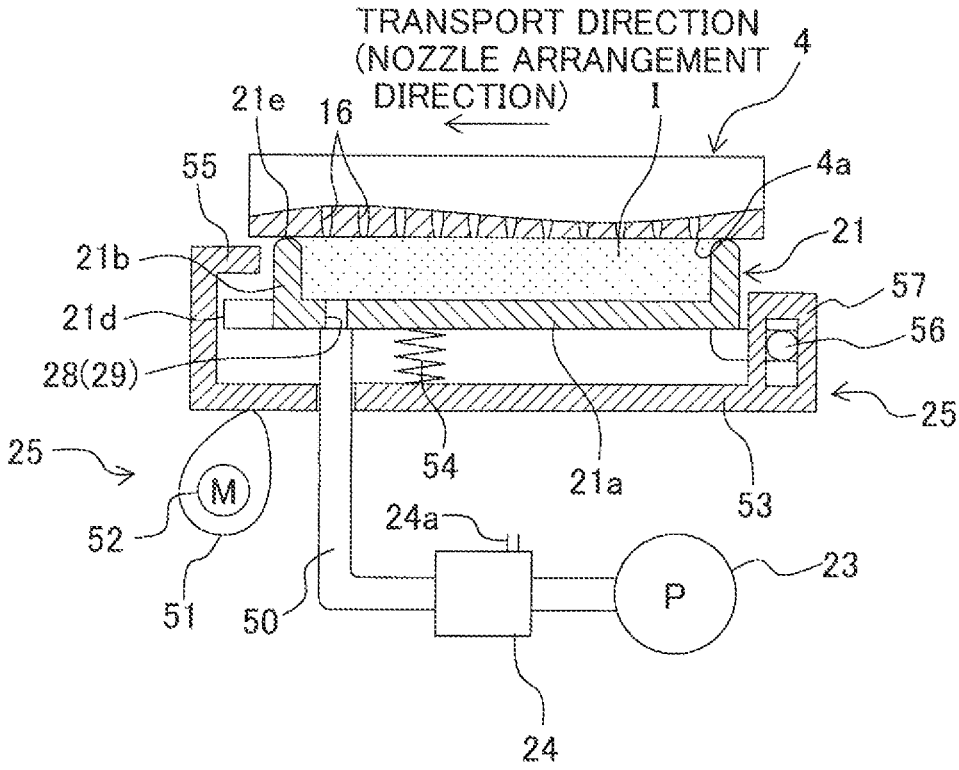
Figure 4B:
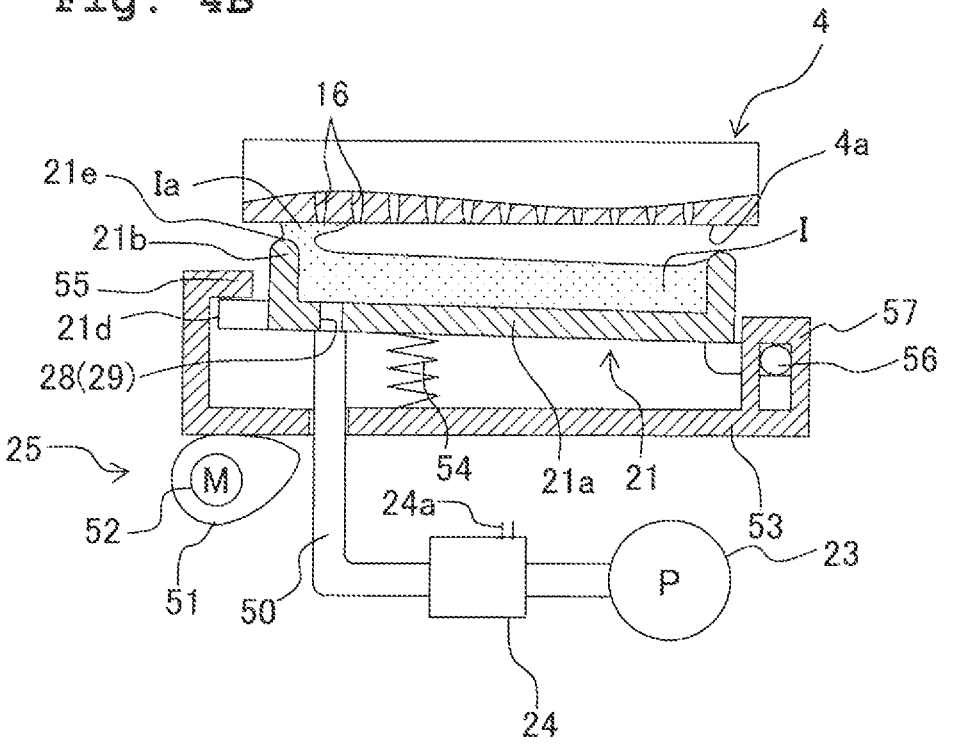
Figure 5A:
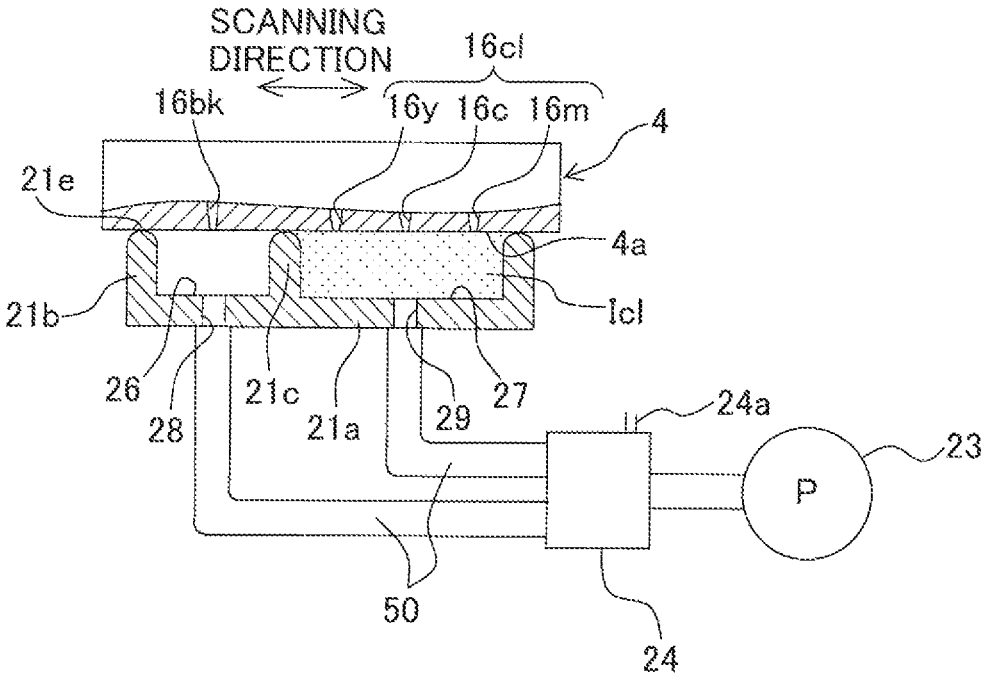
Figure 5B:
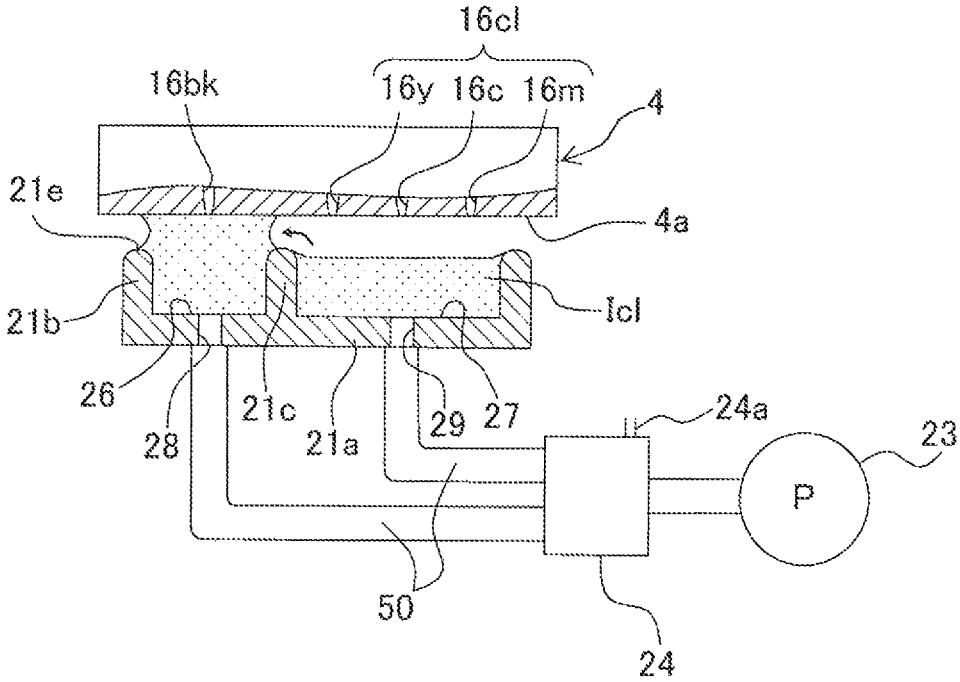

As shown in FIGS. 4A and 4B and FIGS. 5A and 5B, the cap member 21 has a bottom wall section 21*a*, and a lip section 21*b* which is provided at an outer circumferential portion of the bottom wall section 21*a*. The internal space of the cap member 21, which is surrounded by the lip section 21*b*, is partitioned by a partition wall 21*c* to thereby form a first cap section 26 which has a size to cover the plurality of black nozzles 16*bk* for constructing one array of the nozzle array 33*bk* and a second cap section 27 which covers the plurality of color nozzles 16*cl* (16*y*, 16*c*, 16*m*) for constructing the three arrays of the color nozzle arrays 33*y*, 33*c*, 33*m*. The color nozzles 16*cl*, which constitute the three nozzle arrays, include more nozzles than the black nozzles 16*bk* in which the nozzle array is one. Therefore, the second cap section 27, which has the size to commonly cover the color nozzles 16*cl*, has an areal size (internal volume) greater than that of the first cap section 26 which covers the black nozzles 16*bk*. The cap member 21 makes contact/separation with respect to the ink-jetting surface 4*a* by means of a cap driving mechanism 25 (moving mechanism) as described later on. When the cap member 21 is brought in contact with the ink-jetting surface 4*a*, then the black nozzles 16*bk* are covered with the first cap section 26, and the color nozzles 16*cl* are covered with the second cap member 27. In FIGS. 5A and 5B, the cap driving mechanism 25 is omitted from the illustration.

Suction ports 28, 29 are formed at first end positions (end positions disposed on the downstream side in the transport direction) in the arrangement direction of the respective nozzles, of the bottom wall portion of the first cap section 26 and the bottom wall portion of the second cap section 27 respectively. The two suction ports 28, 29 are connected to a switching unit 24 by means of tubes 50 respectively. Further, the switching unit 24 is connected to a suction pump 23. The switching unit 24 has a switching valve (not shown) disposed therein. As shown in FIG. 5A, when the cap member 21 is in the capping state, the switching unit 24 allows the suction pump 23 to communicate with any one of the first cap section 26 and the second cap section 27. In this state, the interior of the cap section 26 (27) allowed to be in communication is subjected to the suction by means of the suction pump 23. Accordingly, the ink I is discharged from the nozzles 16 covered with the cap section 26 (27). That is, the suction purge is individually performed for the black nozzles 16*bk* and the color nozzles 16*cl*.

Figure 6:
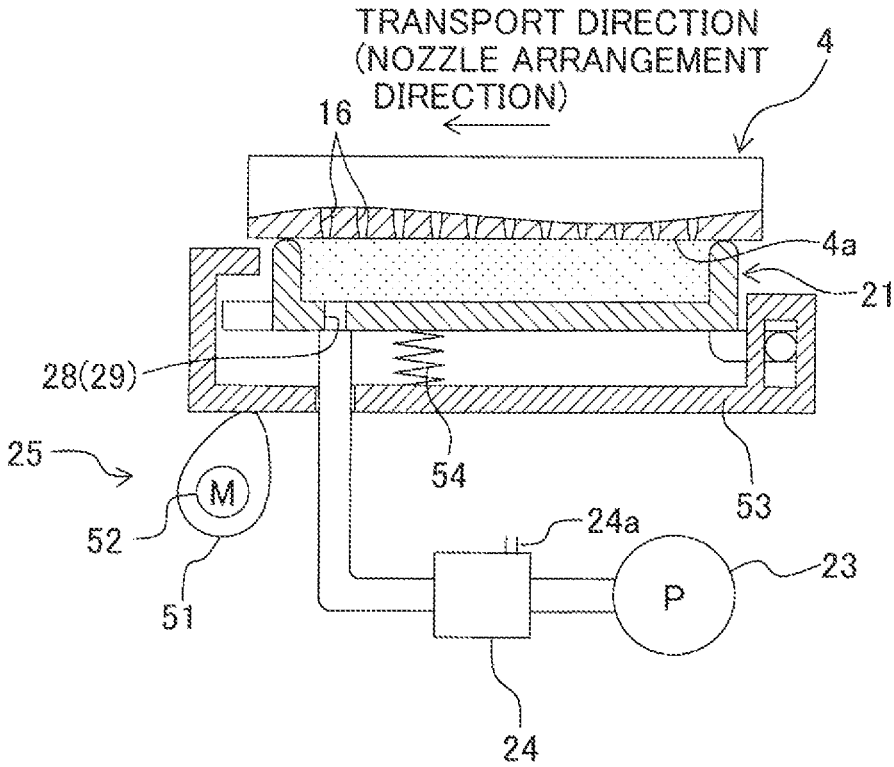
FIG. 6 shows a sectional view in relation to the vertical plane including the transport direction to illustrate the cap member in a nozzle protecting state.

The cap member 21 is also used in a state in which the ink-jet head 4 is not used (in a state in which the inks are not jetted) other than the suction purge as described above. As shown in FIG. 6, when the ink-jet head 4 is not used, the cap member 21 is brought in contact with the ink-jetting surface 4*a* to cover the nozzles 16 therewith. Accordingly, the nozzles 16 are protected, and the inks contained in the nozzles 16 are suppressed from being dried. In this embodiment, the switching unit 24 has an atmospheric air communicating section 24*a*. When the ink-jet head 4 is not used, the space in the cap member 21 is communicated with the atmospheric air via the two suction ports 28, 29 and the atmospheric air communicating section 24*a*. Accordingly, the cap member 21 is prevented from being deformed and a part thereof is prevented from being separated from the ink-jetting surface 4*a*, which would be otherwise caused by the fluctuation of the internal pressure in the cap member 21 resulting from the external temperature change. That is, the switching unit 24 corresponds to the switching mechanism of the present invention which performs the switching or changeover between the suction purge enabled state in which the suction ports 28, 29 of the cap member 21 are connected to the suction pump 23 and the atmospheric air communicated state in which the suction ports 28, 29 of the cap member 21 are communicated with the atmospheric air.

The cap member 21 is constructed tiltably so that the lip section 21*b*, which makes contacts with the ink-jetting surface 4*a*, has one end portion of the forward end surface (contact surface 21*e*) in the arrangement direction (transport direction) of the nozzles 16, the one end portion being disposed nearer to the ink-jetting surface 4*a* as compared with the other end portion. The cap driving mechanism 25 (moving mechanism) separates the cap member 21 in the inclined state from the ink-jetting surface 4*a*.

As shown in FIG. 4, the cap driving mechanism 25 includes a cam 51 which has a predetermined profile, a cam driving motor 52 which drives and rotates the cam 51, and a cap holder 53 which accommodates the cap member 21. The cap holder 53 has a box-shaped form which is open at the upper portion. The cap member 21 is accommodated in the cap holder 53. A coil spring 54 is provided on an inner bottom portion of the cap holder 53. The cap member 21 is urged upwardly by the coil spring 54.

The cap member 21 is provided with a fastening projection 21*d* which protrudes at one end portion of the bottom wall section 21*a* (end portion disposed on one side in the nozzle arrangement direction). On the other hand, a projection-shaped stopper 55, which is engageable with the fastening projection 21*d*, is provided for the cap holder 53 on a side of the one end portion of the cap member 21. The stopper 55 is positioned over or above the fastening projection 21*d*. The cap member 21, which is urged by the coil spring 54, has the upper limit position which is defined by the abutment of the fastening projection 21*d* against the stopper 55.

A pivot support shaft 56, which extends in the direction perpendicular to the paper surface of FIG. 4, is provided at the end portion disposed on the side opposite to the fastening projection 21*d* of the cap member 21. Further, a bearing section 57, which slidably supports the pivot support shaft 56, is provided at the end portion disposed on the side opposite to the stopper 55 of the cap holder 53. Therefore, the cap member 21 is rotated about the center of the pivot support shaft 56 when the pivot support shaft 56 abuts against the ceiling portion of the bearing section 57 as shown in FIG. 4B. Accordingly, the cap member 21 is movable between the lower limit position at which the end portion of the cap member 21 disposed on the side of the fastening projection 21*d* abuts against the inner bottom surface of the cap holder 53 and the upper limit position at which the fastening projection 21*d* abuts against the stopper 55.

The circumferential surface of the cam 51 abuts against the lower surface of the cap holder 53 which accommodates the cap member 21 as described above. The cam 51 is driven and rotated by the cam driving motor 52. The cap holder 53 (and the cap member 21) is driven and moved upwardly/downwardly in accordance with the phase (angle of rotation) of the cam 51. When the cam 51 is rotated in the counterclockwise direction when the ink-jet head 4 is at the maintenance position A (see FIG. 1), then the cap holder 53 is pushed and moved upwardly in accordance with the profile of the cam 51 to provide the capping state in which the cap member 21 is brought in contact with the ink-jetting surface 4*a* to cover the nozzles 16 therewith as shown in FIG. 4A. When the interior of the cap member 21 is subjected to the suction by the suction pump 23 in this state, then the pressure in the cap member 21 (first cap section 26, second cap section 27) is lowered, and the inks are discharged from the nozzles 16 into the cap sections 26, 27 (suction purge).

On the other hand, when the cam 51 is rotated in the clockwise direction as starting from the state shown in FIG. 4A, the cap holder 53 is moved downwardly by means of the self-weight in accordance with the profile of the cam 51. In this situation, the cap member 21 is urged upwardly by the coil spring 54, while the pivot support shaft 56 abuts against the ceiling portion of the bearing section 57 of the cap holder 53, in relation to the right end portion of the cap member 21 as shown in the drawing. Therefore, the right end portion of the cap member 21 shown in the drawing is separated earlier in accordance with the downward movement of the cap holder 53. Accordingly, as shown in FIG. 4B, the contact surface 21*e* of the cap member 21 is separated from the ink-jetting surface 4*a* in such an attitude or posture that the left end portion shown in the drawing (one end portion in the nozzle arrangement direction) is positioned upwardly (while providing the shorter distance from the jetting surface 4*a*) as compared with the right end portion (the other end portion in the nozzle arrangement direction).

When the cap member 21 is separated from the ink-jetting surface 4*a* in the inclined state as described above, the ink bridge Ia is locally formed between the ink-jetting surface 4*a* and the end portion (left end portion in the drawing) at which the cap member 21 is separated lastly as shown in FIG. 4B. In this way, the ink bridge Ia is formed at only a part of the outer circumferential portion of the cap member. Accordingly, the scattering of the inks to the surroundings is suppressed when the ink bridge Ia is cut (disconnected or discontinued).

When the cap member 21 is separated from the ink-jetting surface 4*a*, the inks, which stay in the cap member 21, are sucked and discharged by the suction pump 23. The suction ports 28, 29 are formed at the end portion (left end portion in the drawing) of the cap member 21 disposed on the side nearer to the ink jetting surface 4*a* in the inclined attitude of the cap member 21 shown in FIG. 4B, i.e., at the end portion which is separated from the ink-jetting surface 4*a* lastly. In this arrangement, the suction ports 28, 29 are provided in the vicinity of the position of formation of the ink bridge Ia. Therefore, it is possible to reliably discharge the inks in the cap member 21.

With reference to FIG. 1 again, the wiper 22 is provided upstandingly at the position deviated toward the platen 2 as compared with the cap member 21. The carriage 3 is moved in the scanning direction in a state in which the forward end of the wiper 22 is brought in contact with the ink-jetting surface 4*a* after the suction purge. Accordingly, the wiper 22 is moved relatively with respect to the ink-jetting surface 4*a*, and the inks, which are adhered to the ink-jetting surface 4*a*, are wiped out.

The printer 1 of this embodiment is constructed to perform the flashing such that the inks are discharged by jetting the inks from the plurality of nozzles 16 of the ink-jet head 4 respectively at the appropriate timing during the period in which the printing is not performed on the recording paper P. As shown in FIG. 1, a liquid receiving member 58 is installed at a position disposed on the side opposite to the maintenance unit 6 with the platen 2 intervening therebetween (flashing position: Position B at which the carriage 3 is depicted by two-dot chain lines in FIG. 1). The ink-jet head 4 performs the flashing in a state in which the carriage 3 is moved to the flashing position B. The inks, which are discharged from the nozzles 16 in accordance with the flashing, are received by the liquid receiving member 58.

In this embodiment, the flashing is especially performed immediately after the completion of the series of maintenance including, for example, the suction purge performed by the maintenance unit 6 (first flashing). Parts of waste inks, which are discharged by the suction purge, are adhered to the ink-jetting surface 4*a*. The waste inks are sucked into the nozzles 16 by the back pressure in the ink-jet head 4 when the cap member 21 is separated from the ink jetting surface 4*a*. In the case of the arrangement in which the second cap section 27 commonly covers the color nozzles 16*cl* of the three colors as in this embodiment, the three color inks are mixed with each other in the second cap section 27 when the suction purge is performed for the color nozzles 16*cl*, and the inks, which are subjected to the color mixture, cause the counterflow into the nozzles 16 and/or adhere to the openings. Further, when the ink-jetting surface 4*a* is wiped out by the wiper 22 after the suction purge, then the ink of the different color adheres to the openings of the nozzles 16, and the ink is sucked into the nozzles 16 in some cases. In order to reliably discharge the waste inks sucked into the nozzles 16 as described above, the flashing is performed upon the completion of the maintenance.

As shown in FIG. 6, the nozzles 16 are covered with the cap member 21 in a state in which the ink-jet head 4 is not used, but the drying (increase in viscosity) arises in the inks in the nozzles 16, because the cap member 21 is in a state of being communicated with the atmospheric air. In view of the above, in order to discharge the viscosity-increased ink from the nozzles 16, the flashing is also performed before the start of use of the ink-jet head 4 (second flashing).

In order to reliably discharge the waste ink and the viscosity-increased ink from the interior of the nozzles 16 in the flashing as described above, it is necessary that the inks should be jetted in an ink amount (flashing amount) which is not less than a certain amount. However, the easiness of the counterflow and the degree of the viscosity increase of the waste ink are not identical in relation to all of the nozzles 16. The appropriate value of the flashing amount differs. In view of the above, in this embodiment, the appropriate flashing amounts are individually set for the respective nozzles 16. This feature will be described in detail below in relation to explanation of the flashing control.

Figure 7:
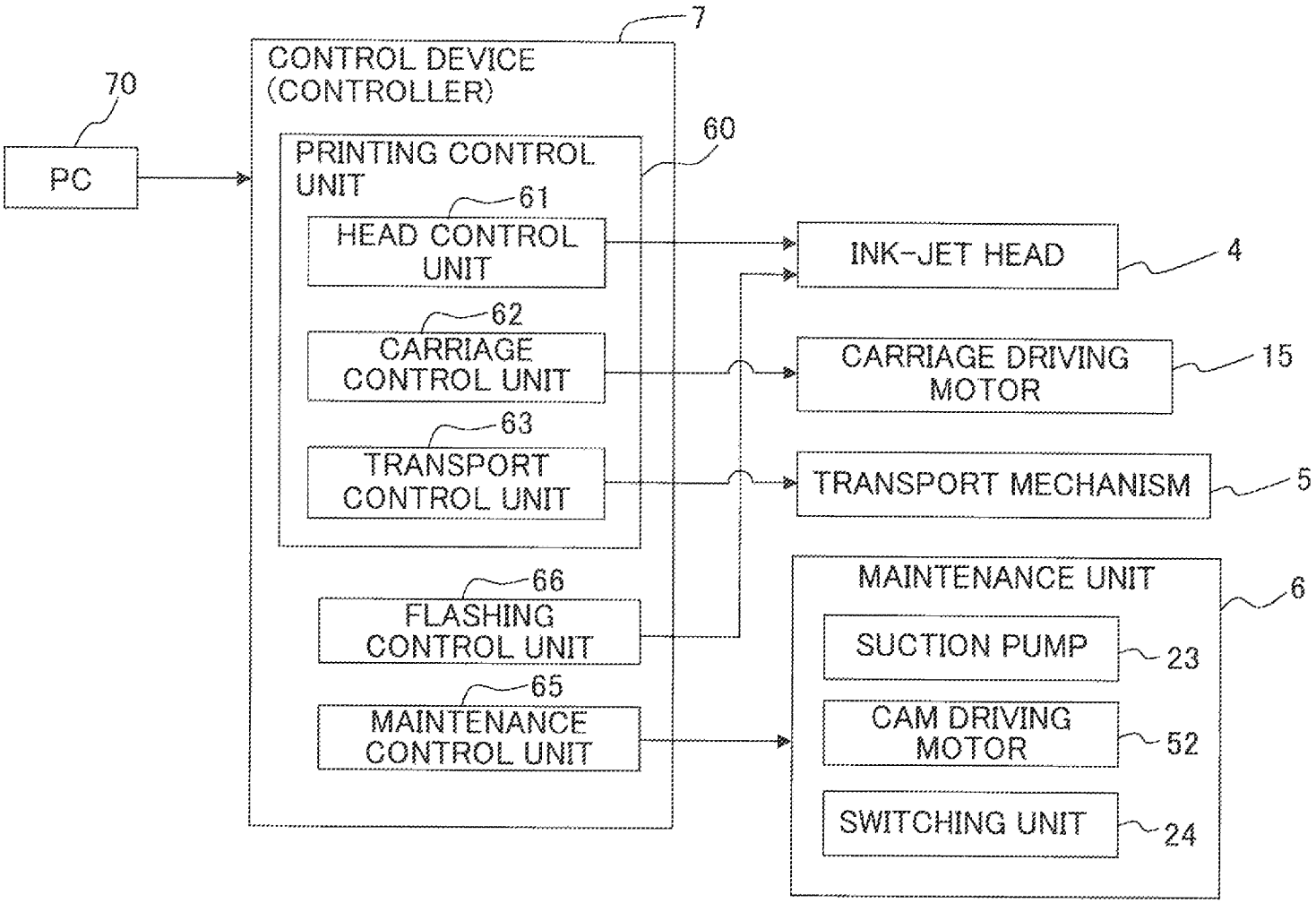
FIG. 7 shows a block diagram schematically illustrating a control system of the printer.

Next, an explanation will be made in detail with reference to a block diagram shown in FIG. 7 about the control system of the ink-jet printer 1 including the control device 7 as a main device. The control device 7 of the printer 1 shown in FIG. 7 includes a microcomputer including, for example, CPU (Central Processing Unit), ROM (Read Only Memory) which stores, for example, various programs and data for controlling the overall operation of the printer 1, and RAM (Random Access Memory) which temporarily stores, for example, data to be processed by CPU. The program stored in ROM is executed by CPU, and thus various control operations are performed as explained below. Alternatively, the control device 7 may be based on a hardware in which various circuits including a calculation circuit are combined.

The control device 7 has a printing control unit 60 including a head control unit 61 which controls the ink-jet head 4, a carriage control unit 62 which controls the carriage driving motor 15 for driving the carriage 3 in the scanning direction, and a transport control unit 63 which controls the transport mechanism 5. The printing control unit 60 controls the ink-jet head 4, the carriage driving motor 15, and the transport mechanism 5 respectively on the basis of the data (printing data) which relates, for example, to an image to be printed and which is inputted from PC (Personal Computer) 70 so that the printing is performed on the recording paper P.

The control device 7 further includes a maintenance control unit 65 which controls, for example, the suction pump 23 of the maintenance unit 6 and the cam driving motor 52 for moving the cap member 21 upwardly/downwardly to control the series of maintenance operation including the suction purge as described above, and a flashing control unit 66 which controls the flashing for the ink-jet head 4. The respective functions of the head control unit 61, the carriage control unit 62, the transport control unit 63, the maintenance control unit 65, and the flashing control unit 66 described above are actually realized by the operation of the microcomputer described above or the operation of the various circuits including the calculation circuit.

An explanation will be made in detail below about the flashing control of the ink-jet head 4 performed by the flashing control unit 66. In this embodiment, the flashing control unit 66 does not set any even or uniform flashing amount for the plurality of nozzles 16 of the ink-jet head 4, but the flashing control unit 66 sets the appropriate flashing amounts for the individual nozzles 16 respectively. The flashing control unit 66 controls the piezoelectric actuator 31 of the ink-jet head 4 on the basis of the flashing amount set as described above so that the liquid droplets are jetted in the flashing amount set for each of the nozzles 16. In order that the respective nozzles 16 have the different flashing amounts, such a technique is appropriately adopted that the number of times of execution of the flashing (number of times of continuous jetting) is changed or the amount of liquid droplets jetted in one time of execution of the flashing is changed.

In this procedure, as described above, the printer 1 of this embodiment carries out, as the flashing as described above, at least the flashing after the completion of the maintenance including the suction purge (hereinafter referred to as "flashing after the purge") and the flashing to be performed immediately before the start of the use of the ink-jet head 4 after the certain rest period (hereinafter referred to as "flashing before the use"). In this case, the object of the flashing differs between the flashing after the purge and the flashing before the use. Therefore, the flashing amount, which is set for each of the individual nozzles 16, also differs therebetween. The setting of the flashing amount will be explained below, while being classified in relation to the flashing after the purge (first flashing) and the flashing before the use (second flashing) respectively.

Flashing after Purge

As mentioned above, as shown in FIG. 4B, when the suction purge is completed, the cap member 21 is separated from the ink-jetting surface 4*a* of the ink-jet head 4 in the state of being inclined with respect to the nozzle arrangement direction (transport direction). During this process, the end portion (left end portion shown in the drawing), which is formed with the suction ports 28, 29 and which is disposed at the one end side in the nozzle arrangement direction of the cap member 21, is the portion which is lastly separated from the ink-jetting surface 4*a*. The ink bridge Ia is locally formed at this position by the waste ink I between the cap member 21 and the ink jetting surface 4*a*. Therefore, a large amount of the waste ink I tends to be sucked into the nozzles 16 disposed near to the ink bridge Ia.

Accordingly, the flashing control unit 66 makes the setting such that the larger flashing amount is provided for the nozzles 16 disposed near to the position of the ink-jetting surface 4*a* at which the cap member 21 is separated at last, i.e., the nozzles 16 positioned on the left side as shown in FIGS. 4A and 4B (on the downstream side in the transport direction), among the nozzles 16 arranged in the transport direction on the ink-jetting surface 4*a*. On the contrary, the nozzles 16, which are positioned on the right side as shown in FIGS. 4A and 4B (on the upstream side in the transport direction), are positioned far from the ink bridge Ia, and the waste ink I is hardly sucked into the nozzles 16. Therefore, the smaller flashing amount is provided for such nozzles 16. Accordingly, the total amount of the ink, which is consumed during the flashing, can be suppressed to be small.

In particular, in this embodiment, the color nozzles 16*cl* for the three colors, which jet the three color inks respectively, are commonly covered with the second cap section 27. Therefore, the waste inks of three colors exist in a mixed state in the second cap section 27 after the suction purge. The color mixture ink is sucked into the color nozzles 16*cl* disposed at the positions near to the ink bridge Ia. Accordingly, in order that the color mixture ink can be reliably discharged, the larger flashing amount is provided for the nozzles 16 which are positioned on the left side as shown in FIG. 4 (on the downstream side in the transport direction) among the plurality of color nozzles 16*cl* arranged in the transport direction.

As shown in FIG. 5, the first cap section 26 for covering the black nozzles 16*bk* and the second cap section 27 for covering the color nozzles 16*cl* are partitioned by the partition wall 21*c*. Therefore, when the suction purge is performed, the black ink Ibk and the color inks Icl are not mixed with each other unlike the mixture of the color inks of the three colors in the second cap section 27 as described above. However, when the cap member 21 is separated from the ink-jetting surface 4*a* after the completion of the suction purge, there is such a possibility that the ink or inks may flow from one cap section into the other cap section to cause the color mixture.

In this arrangement, the number of the color nozzles 16*cl* is greater than that of the black nozzles 16*bk*. Therefore, the total amount of the inks discharged from the color nozzles 16*cl* by the suction purge is greater than the total amount of the ink discharged from the black nozzles 16*bk*. Further, the internal volume (areal size) of the second cap section 27 for covering the color nozzles 16*cl* is greater than the internal volume (areal size) of the first cap section 26 for covering the black nozzles 16*bk*. Therefore, when the cap member 21 is separated from the ink-jetting surface 4*a*, as shown in FIG. 5B, the following situation may be caused highly possibly. That is, a relatively large amount of the color inks may flow to the first cap section 26 while traveling beyond the partition wall 21*c* from the second cap section 27 having the large waste ink amount, and the mixing of the inks may be caused in the first cap section 26. Further, the internal volume (areal size) of the first cap section 26 is small. Therefore, the color inks, which inflow, are hardly spread widely or broadly in a flat or planar form, and the bridge of the mixed ink tends to appear at the first cap section 26.

As described above, it is feared that the color mixture ink may counterflow into the black nozzles 16*bk* to be covered with the exclusive first cap member 26 as well. Therefore, the greater flashing amount is provided for the nozzles 16 positioned on the left side as shown in FIGS. 4A and 4B (on the downstream side in the transport direction) among the black nozzles 16*bk* arranged in the transport direction as well. In particular, in this embodiment, the color inks are the dye inks, while the black ink is the pigment ink. If the dye ink and the pigment ink are mixed with each other, it is feared that the coagulation may arise to cause the nozzle clog-up. Therefore, it is preferable that the flashing is performed sufficiently for the black nozzles 16*bk* which involves such a possibility that the waste ink mixed with the color inks may be sucked thereinto.

The three color inks are definitely mixed with each other in the second cap section 27 for commonly covering the color nozzles 16*cl* for the three colors. On the contrary, the situation, in which the color inks travel beyond the partition wall 21*c* from the second cap section 27 to the first cap section 26 and the color inks are mixed with the black ink, is not always caused. Further, even when the mixing is caused, it is considered that the amount of the color inks mixed with the black ink is not so large. Therefore, when the flashing amounts are increased for the nozzles 16 disposed near to the position of formation of the ink bridge Ia respectively among both of the black nozzles 16*bk* and the color nozzles 16*cl*, it is also allowable that the flashing amount for the black nozzles 16*bk* is set to be relatively smaller than that for the color nozzles 16*cl*.

Flashing Before Use

One of the principal objects of the flashing before the use is to discharge the viscosity-increased ink contained in the nozzles 16. Therefore, unlike the flashing after the purge as described above, the flashing amount is set for the respective nozzles 16 depending on the degree of advance of the drying (degree of the viscosity increase of the ink). In this procedure, as described above, when the nozzles 16 are covered with the cap member 21 in the state in which the ink-jet head 4 is not used, the suction ports 28, 29 of the two cap sections 26, 27 of the cap member 21 are communicated with the atmospheric air by means of the switching unit 24. In this situation, the humidity distributions, which correspond to the distances from the suction ports 28, 29, exist in the two cap sections 26, 27 respectively. Therefore, the drying of the ink is advanced more slowly and the degree of the viscosity increase of the ink is more decreased with respect to the nozzles 16 which have the farther distances from the suction ports 28, 29 among the plurality of nozzles 16 covered with the cap sections 26, 27.

Accordingly, when the flashing amounts are more decreased for, the nozzles 16 which are positioned on the right side as shown in FIG. 6 (on the upstream side in the transport direction) and which have the farther distances from the suction ports 28, 29, it is possible to suppress the consumption amounts of the liquids in the flashing before the use. In this embodiment, the end portion of the cap member 21, which is lastly separated from the ink-jetting surface 4*a*, is the same as the end portion at which the suction ports 28, 29 are provided (left end portion as shown in FIGS. 4A and 4B and FIG. 6) (on the downstream side in the transport direction). Therefore, the large flashing amounts are consequently set for the nozzles 16 positioned on the left side as shown in FIGS. 4A and 4B and FIG. 6 (on the downstream side in the transport direction)

among both of the flashing after the purge as described above and the flashing before the use referred to herein.

Next, modified embodiments, in which various modifications are applied to the embodiment described above, will be explained. However, the components or parts, which are constructed in the same manner as those of the embodiment described above, are designated by the same reference numerals, any explanation of which will be appropriately omitted.

Figure 8:
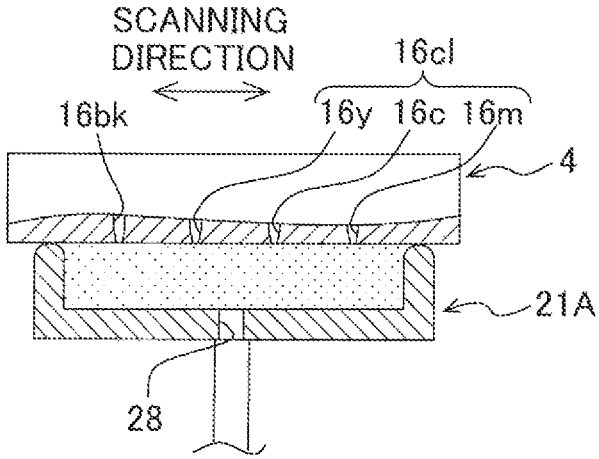
FIG. 8 shows a sectional view in relation to the vertical plane including the scanning direction to illustrate a cap member according to a modified embodiment.

As shown in FIG. 8; a cap member 21A may have a size to commonly cover the openings of the four types of nozzles 16, i.e., the black nozzles 16*bk* and the color nozzles 16*cl* for the three colors. In this case, the four color inks are mixed with each other in the cap member 21A, and the color mixture ink is sucked into the four types of nozzles 16 respectively. Therefore, the flashing amounts are increased for the nozzles 16 disposed near to the position of formation of the ink bridge at which the cap member 21A is separated at last, among the four types of nozzles 16 respectively.

Figure 9:
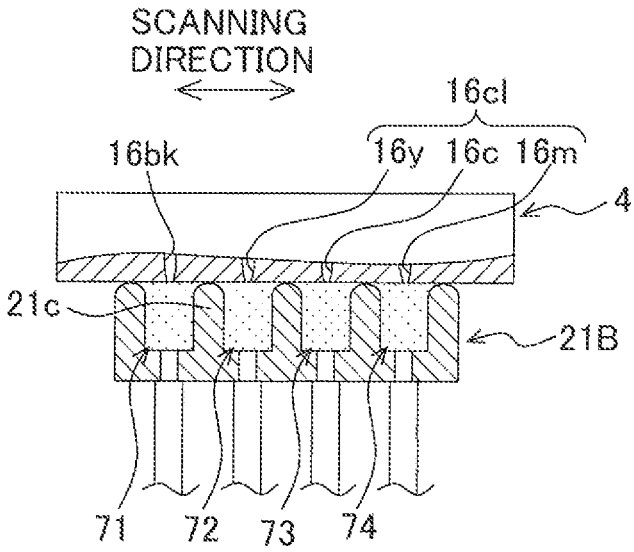
FIG. 9 shows a sectional view in relation to the vertical plane including the scanning direction to illustrate a cap member according to another modified embodiment.

As shown in FIG. 9, a cap member 21B may have four cap sections 71 to 74 which haves sizes to individually cover the respective types of the openings of the four types of nozzles 16 partitioned by partition walls 21*c*. In this case, the four color inks, which are discharged from the four types of the nozzles 16, are not directly mixed with each other. However, when the cap member 21B is separated from the ink-jetting surface 4*a*, it is feared that the inks may be moved beyond the partition walls 21*c* between the adjoining cap sections 71 to 74 to form the ink bridge of the color mixture ink. Accordingly, the flashing amounts are more increased for the nozzles 16 disposed near to the portion at which the cap member 21B is lastly separated, among the four types of nozzles 16 respectively.

In the embodiment described above, the suction ports 28, 29, which are connected to the suction pump 23, are formed at the end portion of the cap member 21 to be separated from the ink-jetting surface 4*a* last. However, the position, at which the suction port is formed, is not limited to the position as described above. When the position of the suction port is changed from that described in the foregoing embodiment, the nozzles 16, for which the flashing amount is increased, have different positions between the flashing after the purge and the flashing before the use, because the flashing amount in the flashing before the use is set based on the distance from the suction port.

Figure 10:
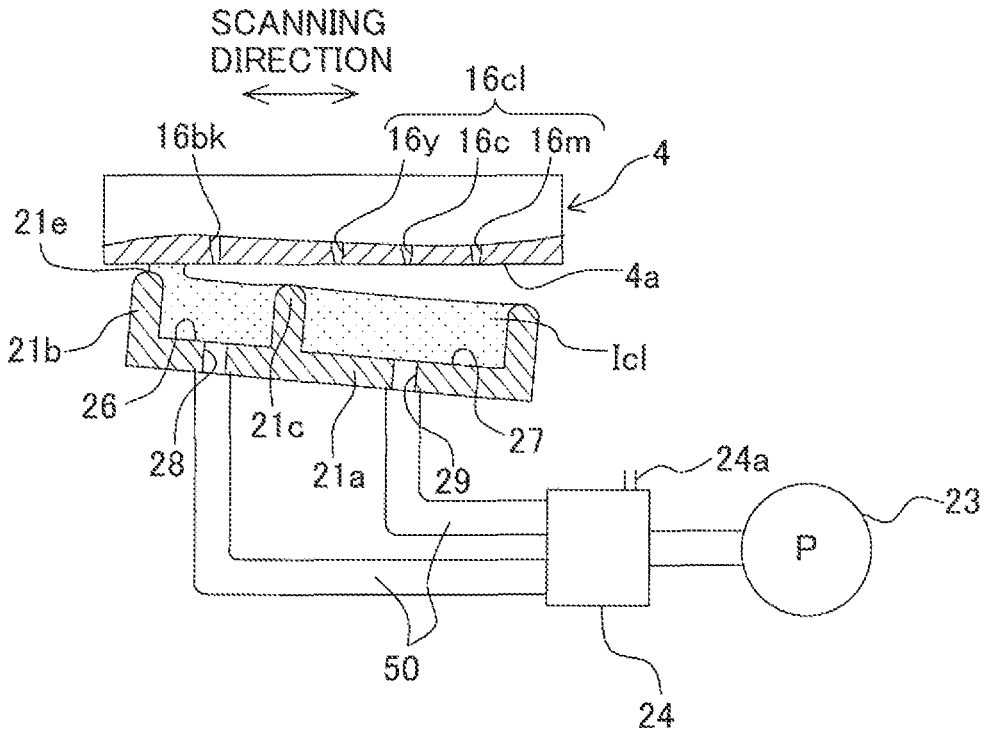
FIG. 10 shows a sectional view corresponding to FIG. 5B, to illustrate a cap member according to still another modified embodiment.

In the embodiment described above, the contact surface 21*e* of the cap member 21 is separated from the ink-jetting surface 4*a* in such an attitude or posture that one end portion in the nozzle arrangement direction has the distance from the jetting surface 4*a* shorter than that of the other end portion as shown in FIG. 4B. However, the way of separation of the cap member 21 from the ink-jetting surface 4*a* is not limited thereto. For example, as shown in FIG. 10, the contact surface 21*e* of the cap member 21 may be separated from the ink-jetting surface 4*a* in such an attitude or posture that one end portion in the scanning direction (end portion disposed on the side of the black nozzles 16*bk* as shown in FIG. 10) has the distance from the jetting surface 4*a* shorter than that of the other end portion (end portion disposed on the side of the color nozzles 16*cl*).

In the embodiment described above, the suction pump 23, which is connected to the cap member 21, is used as the purge mechanism. However, the purge mechanism is not limited to the suction pump 23 provided that the foreign matter, the bubble and the like contained in the ink-jet head 4 can be discharged together with the ink. For example, a pressurizing pump may be provided on the upstream side in the ink supply direction with respect to the ink-jet head 4, the pressure may be applied to the ink contained in the ink-jet head 4 from the upstream side in the ink supply direction, and thus the foreign matter, the bubble and the like contained in the ink-jet head 4 may be forcibly discharged together with the ink. However, even in the case of this arrangement, it is necessary to provide the suction pump 23 connected to the suction ports 28, 29 of the cap member 21 in order to suck the waste ink discharged into the cap member 21.

There is no limitation to the form in which the ink-jet head 4 jets the dye ink and the pigment ink respectively. All of the inks of the plurality of types may be dye inks, or all of them may be pigment inks.

The present invention is also applicable sufficiently significantly to a form in which the inks of different types are not mixed with each other, for example, a form in which the cap member covers only the nozzles 16 for one color of the ink-jet head 4 during the suction purge, and a form in which the ink jetted by the ink-jet head 4 is the ink of one color. That is, even when the waste ink (discharged ink), which is discharged by the suction purge, is not the color mixture ink, it is not preferable that the waste ink containing the bubble and/or the contaminant is sucked into the nozzles 16 again followed by being left to stand. It is preferable that the waste ink contained in the nozzles is reliably discharged by means of the flashing by applying the present invention.

The embodiment and the modified embodiments thereof explained above have been applied to the ink-jet printer. However, the problem, in which the liquids are mixed with each other after the suction purge, may be also caused in any liquid droplet jetting apparatus to be used for any way of use other than the image recording. Therefore, it is also possible to apply the present invention to the liquid droplet jetting apparatus to be used in a variety of fields.

What is claimed is:

1. A liquid droplet jetting apparatus which jets liquid droplets of a liquid, comprising:

a liquid droplet jetting head which has a liquid droplet jetting surface on which a plurality of nozzles are open to jet the liquid droplets of the liquid;

a cap member which covers openings of the nozzles of the liquid droplet jetting head, which is formed with a suction port, and which has a contact surface to make contact with the liquid droplet jetting surface;

a moving mechanism which moves the cap member to make contact with and separate from the liquid droplet jetting surface;

a purge mechanism which is connected to the suction port of the cap member and which performs purge to discharge the liquid from the nozzles in a state in which the cap member is brought in contact with the liquid droplet jetting surface; and a controller which is configured to control the liquid droplet jetting head, the moving mechanism, and the purge mechanism, wherein: the cap member is tiltable such that the contact surface is inclined with respect to the liquid droplet jetting surface when the cap member is separated from the liquid droplet jetting surface;

after performing the purge by controlling the moving mechanism and the purge mechanism, the controller controls the moving mechanism such that the cap member is separated from the liquid droplet jetting surface in an inclined state in which the contact surface is inclined with respect to the liquid droplet jetting surface and the controller controls the liquid droplet jetting head such that first flashing is performed to discharge the liquid by jetting the liquid droplets from the plurality of nozzles respectively; and in the first flashing, the controller controls the liquid droplet jetting head such that a discharge amount from a first nozzle of the nozzles is greater than a discharge amount from a second nozzle of the nozzles, the second nozzle being disposed farther than the first nozzle from a position, on the liquid droplet jetting surface, at which a part of the contact surface of the cap member is lastly separated from the liquid droplet jetting surface when the cap member in the inclined state is separated from the liquid droplet jetting surface.

2. The liquid droplet jetting apparatus according to claim 1, wherein the purge mechanism performs suction purge to discharge the liquid from the nozzles by sucking interior of the cap member.

3. The liquid droplet jetting apparatus according to claim 2, further comprising:

a switching mechanism which switches the cap member between a first state in which the suction port is connected to the purge mechanism and the suction port is not communicated with atmospheric air and second state in which the suction port is communicated with the atmospheric air, wherein: the controller controls the moving mechanism such that the cap member, which is brought in contact with the liquid droplet jetting surface in the second state and which covers the plurality of nozzles, is separated from the liquid droplet jetting surface; and the controller thereafter controls the liquid droplet jetting head such that second flashing is performed to discharge the liquid by jetting the liquid droplets from the plurality of nozzles respectively, and the controller controls the liquid droplet jetting head such that a discharge amount from third nozzle is greater than a discharge amount from fourth nozzle in the second flashing, the fourth nozzle being disposed farther than the third nozzle from the suction port of the cap member in a state in which the liquid droplet jetting surface is covered with the cap member.

4. The liquid droplet jetting apparatus according to claim 1, wherein:

the liquid includes a plurality of types of liquids, the liquid droplet jetting head has a plurality of types of nozzles for jetting liquid droplets of the plurality of types of liquids respectively; and the cap member commonly covers openings of the plurality of types of nozzles.

5. The liquid droplet jetting apparatus according to claim 1, wherein:

the liquid includes a plurality of types of liquids, the liquid droplet jetting head has a plurality of types of nozzles for jetting liquid droplets of the plurality of types of liquids respectively; and the cap member has a plurality of cap sections which are partitioned by partition walls and each of which individually covers openings of one type of nozzles of the plurality of types of nozzles, and the suction port includes a plurality of suction ports each of which is formed for one of the plurality of cap sections.

6. The liquid droplet jetting apparatus according to claim 5, wherein:

the plurality of types of liquids include a first ink and a second ink which is different from the first ink;

the liquid droplet jetting head has a plurality of first-ink nozzles which are aligned in a predetermined arrangement direction to form a first-ink nozzle array and through which liquid droplets of the first ink are jetted, and a plurality of second-ink nozzles which are aligned in the arrangement direction to form a second-ink nozzle array such that the second-ink nozzle array is arranged, side by side, with the first-ink nozzle array in a direction intersecting the arrangement direction, a number of which is greater than that of the first-ink nozzles, and through which liquid droplets of the second ink is jetted;

the cap member has a first cap section which covers the plurality of first-ink nozzles, and a second cap section of which internal volume is greater than that of the first cap section and which covers the plurality of second-ink nozzles;

the cap member is constructed tiltably such that one side in the arrangement direction of the contact surface with respect to the liquid droplet jetting surface comes nearer to the liquid droplet jetting surface as compared with the other side; and the controller controls the liquid droplet jetting head to perform the first flashing for the plurality of first-ink nozzles.

7. The liquid droplet jetting apparatus according to claim 6, wherein the first ink is a black ink and the second ink is a color ink.

8. The liquid droplet jetting apparatus according to claim 6, wherein the controller controls the liquid droplet jetting head not to perform the first flashing for the plurality of second-ink nozzles.

9. The liquid droplet jetting apparatus according to claim 5, wherein:

the plurality of types of liquids include a first ink and a second ink which is different from the first ink;

the liquid droplet jetting head has a plurality of first-ink nozzles which are aligned in a predetermined arrangement direction to form a first-ink nozzle array and through which liquid droplets of the first ink are jetted, and a plurality of second-ink nozzles which are aligned in the arrangement direction to form a second-ink nozzle array such that the second-ink nozzle array is arranged, side by side, with the first-ink nozzle array in a direction orthogonal to the arrangement direction, a number of which is greater than that of the first-ink nozzles, and through which liquid droplets of the second ink is jetted;

the cap member has a first cap section which covers the plurality of first-ink nozzles, and a second cap section of which internal volume is greater than that of the first cap section and which covers the plurality of second-ink nozzles;

the cap member is constructed tiltably such that one side, in the direction orthogonal to the arrangement direction, of the contact surface with respect to the liquid droplet jetting surface comes nearer to the liquid droplet jetting surface as compared with the other side; and the controller controls the liquid droplet jetting head to perform the first flashing for the plurality of first-ink nozzles.

10. The liquid droplet jetting apparatus according to claim 9, wherein the first ink is a black ink and the second ink is a color ink.

11. The liquid droplet jetting apparatus according to claim 9, wherein the controller controls the liquid droplet jetting head not to perform the first flashing for the plurality of second-ink nozzles.

12. The liquid droplet jetting apparatus according to claim 1, wherein the nozzles are arranged in a predetermined arrangement direction and the cap member is constructed tiltably such that one side in the arrangement direction of the contact surface with respect to the liquid droplet jetting surface comes nearer to the liquid droplet jetting surface as compared with the other side.

13. The liquid droplet jetting apparatus according to claim 12, further comprising a carriage on which the liquid droplet jetting head is carried and which is reciprocatively movable in a scanning direction orthogonal to the arrangement direction.

14. The liquid droplet jetting apparatus according to claim 1, wherein the suction port is farmed at an end portion of the cap member, and the end portion is disposed, on a side nearer to the liquid droplet jetting surface when the contact surface of the cap member is inclined with respect to the liquid droplet jetting surface.

* * * * *